US009929542B2

(12) United States Patent
Araya et al.

(10) Patent No.: US 9,929,542 B2
(45) Date of Patent: Mar. 27, 2018

(54) SPARK PLUG AND METHOD FOR MANUFACTURING THE SAME

(71) Applicant: DENSO CORPORATION, Kariya, Aichi-pref. (JP)

(72) Inventors: Kenichi Araya, Kariya (JP); Koji Yamanaka, Kariya (JP); Ken Hanashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/472,673

(22) Filed: Mar. 29, 2017

(65) Prior Publication Data

US 2017/0288373 A1 Oct. 5, 2017

(30) Foreign Application Priority Data

Mar. 30, 2016 (JP) ..... 2016-069213

(51) Int. Cl.

| | |
|---|---|
| ***H01T 13/20*** | (2006.01) |
| ***H01T 13/39*** | (2006.01) |
| ***H01T 13/32*** | (2006.01) |
| ***H01T 21/02*** | (2006.01) |

(52) U.S. Cl.

CPC ..... *H01T 13/39* (2013.01); *H01T 13/32* (2013.01); *H01T 21/02* (2013.01)

(58) Field of Classification Search

CPC ..... H01T 13/39; H01T 21/02; H01T 13/32; H01T 13/20

See application file for complete search history.

(56) References Cited

U.S. PATENT DOCUMENTS

| | | | | |
|---|---|---|---|---|
| 1,361,462 | A * | 12/1920 | Hoffmann | H01T 13/20 123/169 CA |
| 8,760,045 | B2 * | 6/2014 | Kawashima | B23K 9/0026 313/142 |
| 2007/0290596 | A1 * | 12/2007 | Lykowski | H01T 13/20 313/143 |
| 2010/0109502 | A1 | 5/2010 | Nakayama et al. | |
| 2010/0213812 | A1 * | 8/2010 | Kawashima | B23K 9/0026 313/141 |

(Continued)

FOREIGN PATENT DOCUMENTS

| | | |
|---|---|---|
| JP | 2012-089353 | 5/2012 |

*Primary Examiner* — Donald Raleigh
(74) *Attorney, Agent, or Firm* — Nixon & Vanderhye P.C.

(57) ABSTRACT

A spark plug has an elongated center electrode, ground electrode, convex part and noble metal coating layer. The center electrode is held in a housing. The ground electrode has a tip end opposing part opposing the center electrode. The convex part is extended from the tip end opposing part to an opposing part face in an axial direction of the spark plug. A spark discharge gap is formed between a tip end part of the center electrode and the convex part. The noble metal coating layer covers a surface of the convex part. The noble metal coating layer has an end face coating layer covering a projecting end face of the convex part and a side face coating layer covering at least a part of a side face of the convex part extended from the projecting end face. A root part of the side face coating layer is buried in the tip end opposing part. An extension is formed so that at least a part of the root part is extended to an outside of the spark plug along the opposing part face.

8 Claims, 11 Drawing Sheets

(56) References Cited

U.S. PATENT DOCUMENTS

2011/0316408 A1* 12/2011 Suzuki ..... H01T 13/20
313/141
2013/0200773 A1* 8/2013 Sakayanagi ..... H01T 13/32
313/141

* cited by examiner

SPARK PLUG AND METHOD FOR MANUFACTURING THE SAME

CROSS-REFERENCE TO RELATED APPLICATION

This application is based on and claims the benefit of priority from earlier Japanese Patent Applications No. 2016-69213 filed on Mar. 30, 2016, the description of which is incorporated herein by reference.

TECHNICAL FIELD

This disclosure relates to a spark plug for internal combustion engines and a method for manufacturing the spark plug.

BACKGROUND

A spark plug is used as an ignition means of internal combustion engines such as engines for automobiles. In general, faces of center and ground electrodes, which face each other, are respectively disposed with electrode tips to improve ignitability of the spark plug. The electrode tips, for example, are made up of noble metal materials and have columnar shapes. A predetermined spark discharge gap is formed between the electrode tip of the center electrode, which extends to the ground electrode, and the electrode tip of the ground electrode. In addition, spark discharge is generated between the electrode tips which face each other, and the spark discharge ignites an air-fuel mixture.

In addition, changing configurations of the center and the ground electrodes enables reduction in usage of the noble metal materials. In one instance, Japanese patent No. 4775447 will be referred to as patent document 1. Patent document 1 discloses that a welded part is formed on at least a part of a tip end face of a convex part. The welded part is formed by welded the noble metals with a part of an electrode base material. The convex part is a part of a base material of the ground electrode and is projected to the center electrode faced to the ground electrode. Furthermore, in patent document 1, it is proposed that a covering layer including the noble metals is formed on a corner part and a part of a side face of the convex part, thereby enable to suppress a consumption of the corner part and the part of the side face of the ground electrode.

In addition, a rapidly mixed gas stream is formed in a combustion chamber to improve combustion quality in the internal combustion engine. This method of using the rapidly mixed gas stream enables an initial flame to be a large flame by inducing the spark discharge to a center of the combustion chamber. However, the spark discharge may flow to a lateral direction of the ground electrode and reach a base of the convex part of the ground electrode. In this case, the spark discharge reaches a side face of the ground electrode which is not coated with the noble metals, and a problem may occur that the ground electrode is easily consumed. In addition, oxidation of the noble metal materials progresses in a high-temperature atmosphere or if heat stress is repeatedly applied to the ground electrode. Thereby, the noble metal coating layer may detach from the electrode base material.

SUMMARY

An embodiment provides a long-life spark plug, which has consumption resistance and detachment resistance, by reducing consumption of the convex part due to spark discharge and preventing noble materials detaching in a configuration of a convex part mounted on the ground electrode being covered by the noble metal materials. In addition, the embodiment provides a method for manufacturing the spark plug.

In one aspect of the present disclosure, a spark plug has a center electrode, insulator, ground electrode, convex part and noble metal coating layer. The center electrode has a long shaft shape and is held in a cylindrical housing. The insulator is disposed between the center electrode and the housing. In FIGS. 1 and 2, a lower side of the drawing is defined as a tip end side, and an upper side of a drawing is defined as a base end side. The ground electrode is fixed on a tip side of the housing and has a tip end opposing part which is opposed to the center electrode. The convex part is mounted on the tip end opposing part, and extends from an opposing part face of the tip end opposing part, which is opposed to the center electrode, to the center electrode in an axial direction. A spark discharge gap is formed between a tip end of the center electrode and the convex part. The noble metal coating layer covers a surface of the convex part. As can be seen in FIG. 3, the noble metal coating layer has an end face coating layer and a side face coating layer. The end face coating layer covers a projecting end face of the convex part. The side face coating layer covers at least a part of a side face of the convex part following the projecting end face. A root part of the side face coating layer, which is disposed at a side of the tip end of the side face coating layer, is buried in the tip end opposing part. At least a part of the root part extends to an outside of the spark plug along the opposing part face and forms an extension.

Other aspect of the present disclosure is the method for manufacturing the spark plug. The method for manufacturing the spark plug have first and second processes.

In the first process, a plate noble metal chip which become the noble metal coating layer is resistance welding to the plate tip end opposing part. In addition, at least a part of the noble metal chip is buried in the tip end opposing part.

In the second process, in the region where the noble metal chip is buried, a part of the tip end opposing part is extruded to a side of the opposing part face. Thereby, the convex part, which is coated by the end face coating layer and the side face coating layer, is formed. In addition, an extension, which is extended to the outside of the spark plug along from the root part of the side face coating layer to the opposing part face, is integrally formed with the convex part.

According to the configuration of the spark plug, the end face coating layer and the side face coating layer respectively cover the projecting end face and the side face of the convex part of the ground electrode. Thereby, a whole surface of the convex part is coated, and the consumption resistance is improved. In addition, the root part of the side face coating layer and the extension, which is extended to the outside of the spark plug, are buried in the tip end opposing part of the ground electrode. Thereby, the exposure of a boundary face between the extension and the electrode base material becomes minimum. This reduces detaching of the noble metal coating layer due to oxidation caused by high temperature or application of heat stress. Thereby, the detaching resistance is improved.

Accordingly, a long life spark plug, which has combined consumption resistance and detaching resistance, can be realized. In addition, in the spark plug, a zygote, as the noble metal chip buried in at least a part of the tip end opposing part in the ground electrode, is formed in the first process. In addition, a part of the tip end opposing part which becomes the convex part is extruded in the second process. Thereby, the extension, which is extended from at least a part of the root part, and the end face coating layer and the side face coating layer are integrally formed. The end face coating layer and the side face coating layer cover the convex part.

DETAILED DESCRIPTION OF THE PREFERRED EMBODIMENTS

First Embodiment

Figure 1:
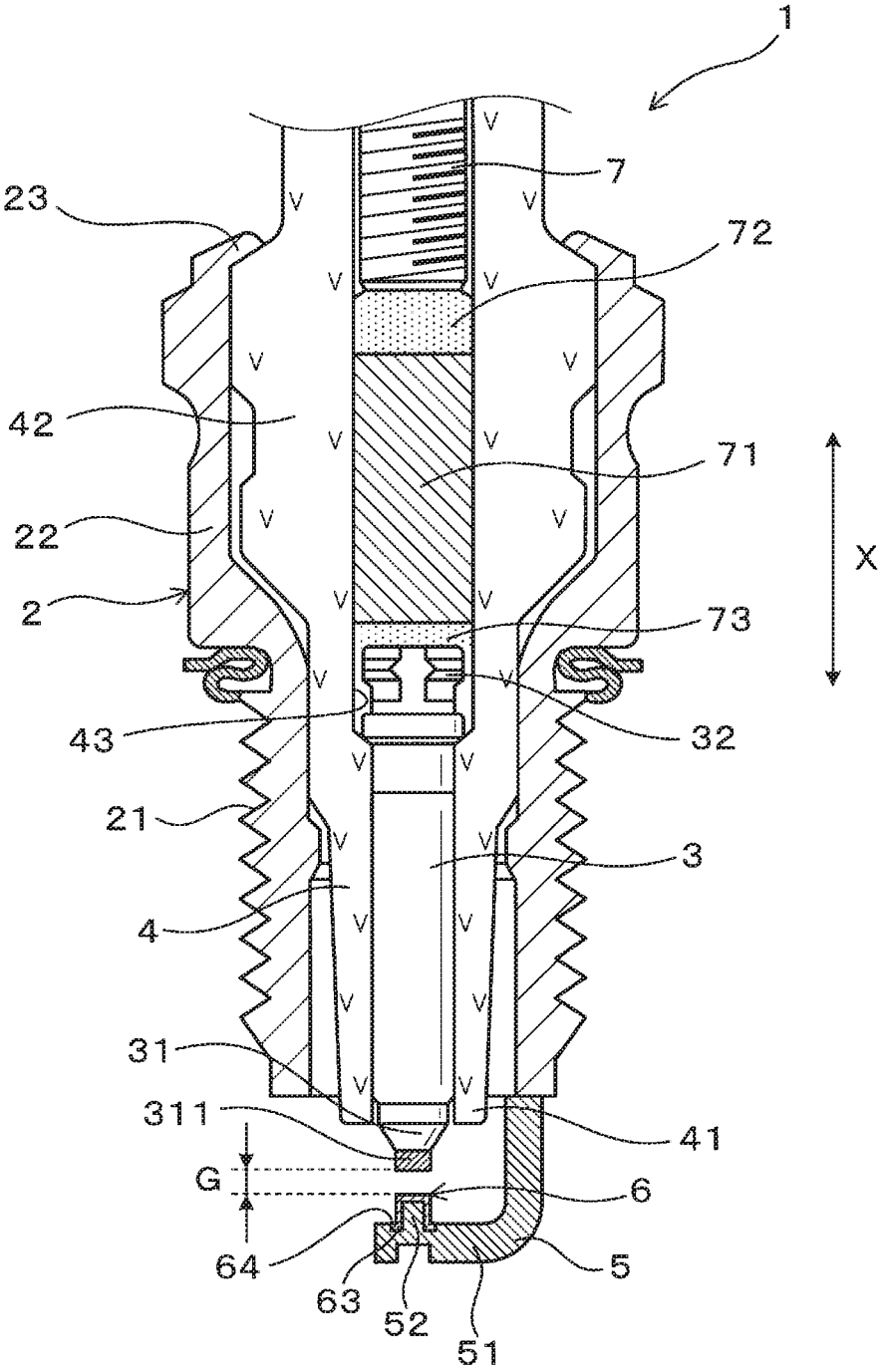
FIG. 1 shows a longitudinal sectional view of an overall configuration of a spark plug according to a first embodiment.
Figure 2:
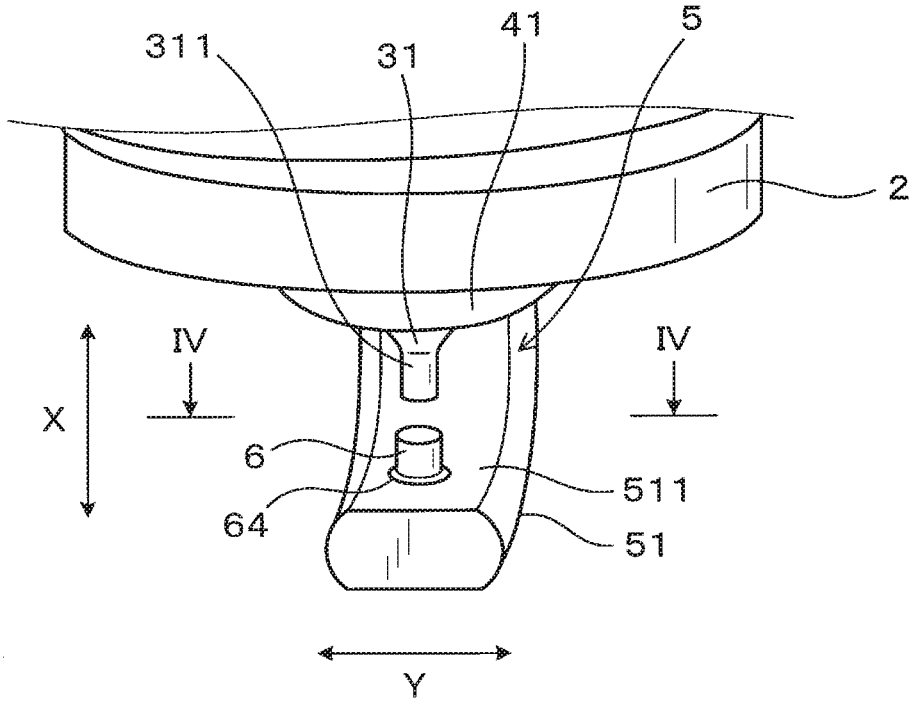
FIG. 2 shows a perspective view of a main part configuration of the spark plug according to the first embodiment.
Figure 3:
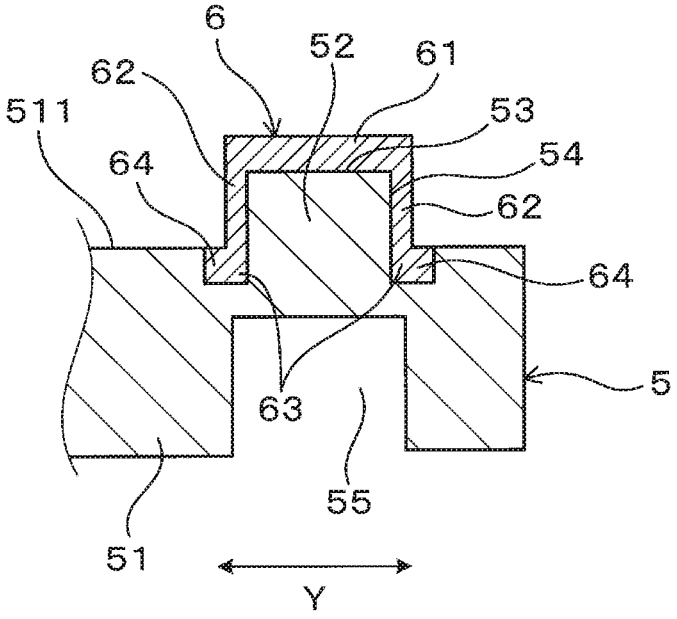
FIG. 3 shows a cross-sectional view of a tip end opposing part configuration of a ground electrode according to the first embodiment.

A first embodiment related to a spark plug for an internal combustion is described by referring to drawings. As shown in FIGS. 1 and 2, a spark plug 1 has a cylindrical housing 2, a center electrode 3, a cylindrical insulator 4 and a ground electrode 5. The center electrode 3 has a long shaft shape and is held in a cylindrical housing 2. The insulator is disposed between the center electrode 3 and the housing 2. In FIGS. 1 to 3, a lower side of a drawing is defined as a tip end side, and an upper side of a drawing is defined as a base end side. The ground electrode 5 is fixed on the tip end side of the housing 2. The ground electrode 5 has a tip end opposing part 51 opposed to the center electrode 3 which is projected to the tip end side of the insulator 4. In the spark plug 1, an axial direction X of the spark plug 1, which is coaxially disposed at the housing 2, the center electrode 3 and the insulator 4, is a vertical direction of FIGS. 1 and 2.

A convex part 52 is projected from the tip end opposing part 51 of the ground electrode 5 to the center electrode 3 in the axial direction X. In addition, a spark discharge gap G is formed between the convex part 52 and the center electrode 3. A noble metal layer 6, which covers a surface of the convex part 52, is disposed on the ground electrode 5. The noble metal layer 6 has an end face coating layer 61, a side face coating layer 62 and an extension 64. The extension 64 is extended from a root part 63 of the side face coating layer 62 to an outside of the spark plug. Details of each part are described below.

The internal combustion engine is, for example, an engine for automobiles. The spark plug 1 is mounted in a mounting hole (not shown) of a cylinder head facing an engine combustion chamber. In the housing 2, a mounting screw part 21 for the cylinder head (not shown) is disposed on an outer periphery of a half part of the tip end side. In addition, a half part of the base end side of the housing 2 is a large-diameter part 22 whose external diameter is larger than that of the housing 2. A large-diameter part 42, which is disposed in an intermediate part of the insulator 4 in the axial direction X, is housed and held in the large-diameter part 22 of the housing 2. A base end edge 23 is fitted and fixed to the base end side of the large-diameter part 22, which is then airtightly sealed thereby.

A tip end part 41 of the insulator 4 is projected to the tip end side more than an opening of the housing 2 on the tip end side. The insulator 4 has an axial hole 43 which penetrates in the axial direction X. The center electrode 3 is housed in the tip end side of the axial hole 43. A base end part 32 of the center electrode 3, which is a large diameter, is supported on a tapered step surface which is disposed on inner periphery of the axial hole 43. A tapered tip end part 31 is projected to the tip end side more than the tip end part 41 of the insulator 4 is. A terminal metal 7 is housed in the base end side of the axial hole 43 of the insulator 4. A resistor 71 is disposed between the terminal metal 7 and the center electrode 3 via conductive seal layers 72, 73.

The terminal metal 7 is connected with a high-voltage source (not shown). The high-voltage source is, for example, an ignition coil and is connected with a vehicle mounted battery. After this, a high voltage for ignition is generated. The high-voltage source is driven using a control signal generated from a controller (not shown). Thereby, the high voltage is supplied to the center electrode 3 via the terminal metal 7, the conductive seal layer 72, the resistor 71 and the conductive seal layer 73. After this, spark discharge is generated between the center electrode 3 and the ground electrode 5.

The ground electrode 5 having a plate-like body is formed so that a whole thereof is bent into an L shape. An end of the base end side of the ground electrode 5 is joined and fixed to a tip end face of the housing 2 on the tip end side. The ground electrode 5 on the tip end side is disposed parallel to the center electrode 3 and extends to the tip end side in the axial direction X. The axial direction X is defined as a center axis A. The ground electrode 5 on the tip end side from the tip end part 31 of the center electrode 3 is bent toward the center axis A and extends in a direction perpendicular to the center axis A. The direction orthogonal to the center axis A is a so-called lateral direction Y shown in FIG. 2. The tip end part 31 of the center electrode 3 (hereinafter referred to as a center electrode tip end part appropriately) becomes smaller in a tapered shape toward a columnar small-diameter part 311. The columnar small-diameter part 311 is projected from the center electrode tip end part to the tip end side. The convex part 52, which is disposed at a position opposed to the columnar small-diameter part 311, is projected from the tip end opposing part 51 of the ground electrode 5.

The tip end opposing part 51 has two surfaces. One surface of the tip end opposing part 51, which is opposite to the center electrode 3, is defined as an opposing part face 511. The other surface of the tip end opposing part 51, which is opposite to the opposing part face 511, is defined as an opposing part rear face 512. The convex part 52 is formed by projecting a part of a base material of the tip end opposing part 51 from the opposing part rear face 512 to the opposing part face 511. A concave part 55, which is opposite to the convex part 52, is formed on the opposing part rear face 512. The noble metal coating layer 6 is formed on a surface of the convex part 52 so as to cover a whole surface of the convex part 52.

Base materials of the center electrode 3 and the ground electrode 5 are metal materials such as, for example, a Ni-based alloy containing Ni (nickel) as a major component. An alloy element added to the Ni-based alloy includes Al (aluminum) or the like. The inside of the center electrode 3 and the ground electrode 5 may also have a core material such as metal materials with excellent thermal conductivity such as, for example, Cu (copper) or a Cu alloy. The columnar small-diameter part 311 can be made up of, for example, a columnar noble metal chip and connected with the center electrode 3 by welding or the like.

The convex part 52 of the ground electrode 5 is formed by projecting a part of the base material of the ground electrode 5 in, for example, a cylinder shape or a cone shape. Thereby, the convex part 52 and the tip end opposing part 51 are integrally formed. The noble metal coating layer 6, which covers the whole surface of the convex part 52, may be formed using, for example, the laminated shape noble metal chip at the time of forming the convex part 52 as described below. Noble metal materials used for the columnar small-diameter part 311 and the noble metal coating layer 6 are, for example, Pt (platinum), Ir (iridium), Rh (rhodium) or the like. A noble metal or a noble metal alloy, which has a predetermined tip shape, including at least one of these noble metals as a major element, may be used. The noble metal alloy may include a Pt—Rh alloy or the like. A Pt—Ni alloy or the like may be used as alloy materials, that is, including metals other than noble metals.

The insulator 4 is made up of a ceramic sintered compact being obtained by firing isolated ceramic materials, for example, alumina or the like, which have been formed in a predetermined shape. In addition, the housing 2 is made up of, for example, steel material such as a carbon steel.

Figure 4:
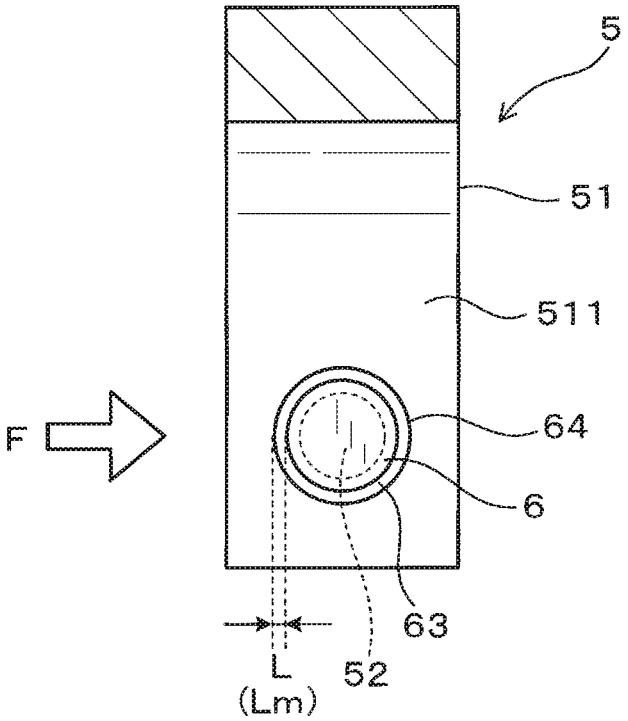
FIG. 4 shows a cross section taken across the line IV-IV in FIG. 2 and a plan view of the tip end opposing part configuration of the ground electrode according to the first embodiment.

As can be seen in FIGS. 3 and 4, the noble metal coating layer 6 has the end face coating layer 61 and the side face coating layer 62. The end face coating layer 61 covers a projecting end face 53 of the convex part 52. The side face coating layer 62 covers a side face 54 of the convex part 52 following the projecting end face 53. The convex part 52 has a cylinder shape. A diameter of the projecting end face 53 and a projecting height of the convex part 52 may be appropriately set so as to obtain predetermined discharge characteristics. This is depending on, for example, a diameter, a projecting height or the like of the columnar small-diameter part 311 of the center electrode 3 opposing the projecting end face 53 and the convex part 52. In this case, a predetermined spark discharge gap G (e.g. refer to FIG. 1) is formed between a tip end (i.e. surface of the end face coating layer 61) of the convex part 52 and the columnar small-diameter part 311. The tip end of the convex part 52 includes the noble metal coating layer 6. The columnar small-diameter part 311 is disposed on the center electrode tip end part 31.

The end face coating layer 61 has a disk shape which covers the projecting end face 53 of the convex part 52 at a predetermined thickness and is connected with the cylindrical side face coating layer 62. The side face coating layer 62 covers a whole outer peripheral surface of the side face 54 of the convex part 52 at the predetermined thickness. In addition, the side face coating layer 62 extends to the root part of the convex part 52 (i.e. an end opposing the projecting end face 53). The root part 63 of the side face coating layer 62 (i.e. another end coating the root part of the convex part 52) is buried in the tip end opposing part 51. The root part 63 may be disposed at least on the tip end side from the opposing part face 511. Thereby, joint performance between the root part 63 and the electrode base material in the tip end opposing part 51 is improved. Furthermore, at least the part of the root part of the side face coating layer 62 extends to the outside of the convex part 52 along the opposing part face 511 in the lateral direction Y and forms the extension 64.

In the present embodiment, the extension 64 is mounted so as to surround a whole circumference of the convex part 52 at a constant width. In this case, a width of the extension 64 is a length L extending in a radial direction (i.e. lateral direction) of the convex part 52 in the opposing part face 511. The length L is hereinafter referred to as an extension length L. A maximum length of the extension length L is defined as a maximum extension length Lm. In the present embodiment, the extension length L is constant and is equal to the maximum extension length Lm (i.e. extension length L=maximum extension length Lm). The maximum extension length Lm may be arbitrarily set. The extension 64 is preferably formed so that the maximum extension length Lm is not less than 0.07 mm. When the maximum extension length Lm of the extension 64 is not less than 0.07 mm, an area of a boundary face, which is buried in the electrode base material, between the extension and the electrode base material, becomes large. Thereby, the progress of cracks leading to detaching the noble metal coating layer 6 from the convex part 52 may be relatively prevented. Thereby, a part of the boundary face exposed to combustion gas is minimized, and progress of oxidation of the boundary face is then prevented. Accordingly, detaching resistance is improved.

In addition, at least a part of the extension 64 is preferably buried in the tip end opposing part 51. In the present embodiment, the root part 63 buried in the tip end opposing part 51 is extended to the outside of the spark plug in the radial direction of the convex part 52 at the predetermined thickness. Thereby, the extension 64 is formed, and a surface of the extension 64 is formed flat on a surface of the tip end opposing part 51 (e.g. refer to FIG. 3). In this way, the whole of the extension 64 is buried in the tip end opposing part 51. Thereby, the area of the boundary face contacted with the electrode base material becomes large. In addition, the progress of cracks leading to detaching the noble metal coating layer 6 from the convex part 52 may be relatively prevented. Accordingly, the detaching resistance is improved furthermore.

A thickness of the noble metal coating layer 6 may be arbitrarily set. In the noble metal coating layer 6, thicknesses of the end face coating layer 61, the side face coating layer 62 and the extension 64 may be respectively the same or different. The end face coating layer 61 is opposed to the center electrode tip end part 31 and is a major discharge face. The predetermined spark discharge gap G is formed between the columnar small-diameter part 311 and the end face coating layer 61. The thickness of the end face coating layer 61 is preferably set enough to secure consumption resistance. A thickness of the side face coating layer 62 is set to the same or not less than that of the end face coating layer 61. The side face coating layer 62 covers the whole of the side face 54 of the convex part 52, and the consumption resistance is improved. Preferably, in a range to secure the consumption resistance, an amount used of the noble metals may be reduced by forming the side face coating layer 62 to be thinner.

The thickness of the extension 64 is, for example, set to the same or not more than that of the end face coating layer 61. In addition, the thickness of the extension 64 may be appropriately set depending on a forming range or the maximum extension length Lm. When the thickness of the extension 64 becomes thick, the area of the boundary face buried in the tip end opposing part 51 becomes large. Thereby the progress of the cracks leading to detaching the noble metal coating layer 6 from the convex part 52 may be relatively reduced. Accordingly, the detaching resistance is improved. The thickness of the extension 64 may be constant in a whole length in the radial direction of the extension 64 (e.g. refer to FIG. 3). In addition, the thickness of the extension 64 may also not be constant in the radial direction. For example, the thickness of the extension 64 may also be formed so as to become thinner toward the outside of the spark plug from the root part 63 in the radial direction. Similar relations are satisfied also in the circumferential direction of the convex part 52. A thickness of the whole circumference of the convex part 52 may be constant or different.

Figure 5:
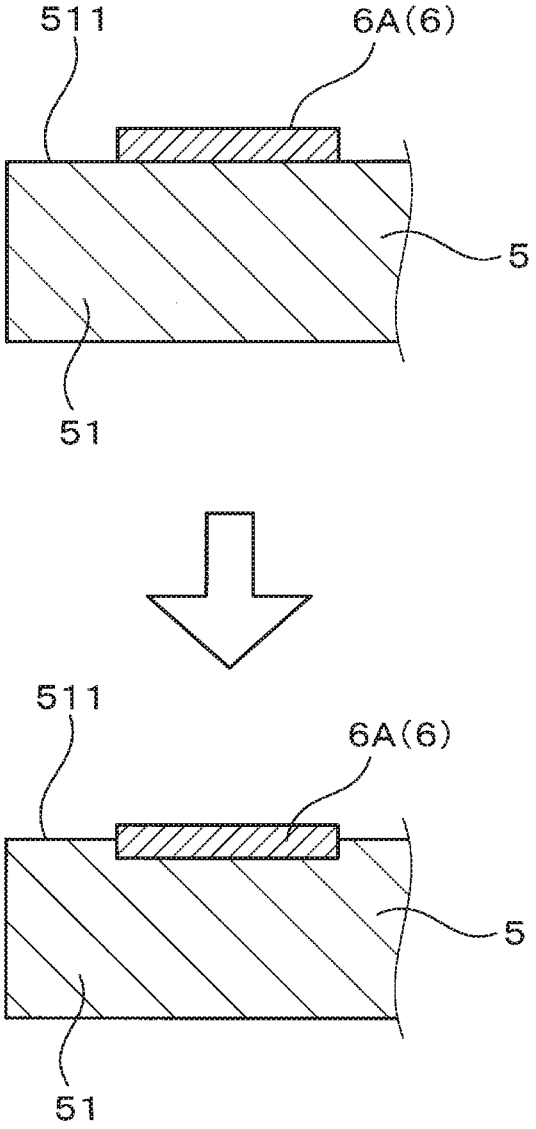
FIG. 5 shows a cross sectional view for explaining a bonding process as a first process for forming a convex part and a noble metal coating layer on the ground electrode according to the first embodiment.
Figure 6:
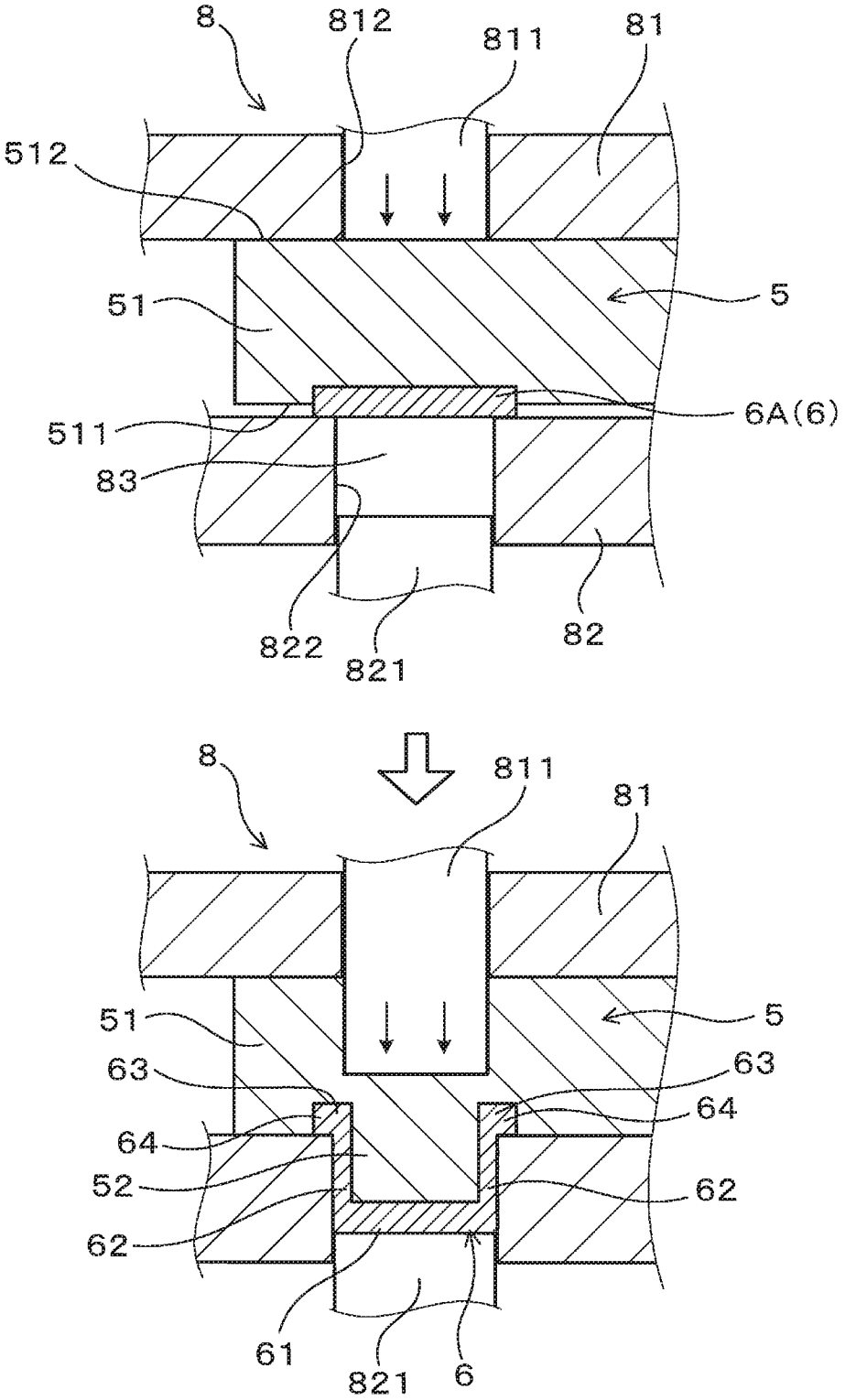
FIG. 6 shows a cross sectional view for explaining a second process for forming the convex part and the noble metal coating layer on the ground electrode according to the first embodiment.

Next, referring to FIGS. 5 and 6, a method of forming the convex part 52 and the noble metal coating layer 6, which cover the whole circumference of the convex part 52, is described below. First, as shown in FIG. 5, in a bonding process as a first process, a noble metal chip 6A as the noble metal coating layer 6 is bonded to the tip end opposing part 51 of the ground electrode 5. Then, as shown in FIG. 6, in a manufacturing process as a second process, a bond part between the tip end opposing part 51 and the noble metal chip 6A is extruded, thereby forming the noble metal coating layer 6 covering the whole of the convex part 52 while forming the convex part 52.

Specifically, as shown in an upper side of FIG. 5, the opposing part face 511 of the plate-like tip end opposing part 51 is disposed facing upwards in FIG. 5. The disk-shaped noble metal chip 6A is disposed on a predetermined position (i.e. forming position of the convex part 52) of the opposing part face 511. After that, as shown in a lower side of FIG. 5, for example, the noble metal chip 6A is bonded to the opposing part face 511 by resistance welding. A known resistance welding is used in the resistance welding. For example, the noble metal chip 6A and the tip end opposing part 51 are held between a pair of electrodes (not shown) and are pressed by the pair of electrodes. Then, a predetermined current flows through the noble metal chip 6A and the tip end opposing part 51. Thereby, the noble metal chip 6A and the opposing part face 511 are melted and bonded to each other.

In the first process, the noble metal chip 6A and the opposing part face 511 are softened and melted. Thereby, the noble metal chip 6A is buried in the tip end opposing part 51, which is disposed on the lower side of the opposing part face 511. This embedded amount may be arbitrarily controlled by controlling the pressure and current or the like during the resistance welding. In the second process after bonding, the embedded amount of the noble metal chip 6A may also be controlled. After the first process, the whole of the noble metal chip 6A need not necessarily be buried in the tip end opposing part 51.

In addition, before and after the first process, the noble metal chip 6A tends to become thick or be expanded in diameter thereof by softening and melting. Allowing for a change of dimension, a shape and a dimension of the noble metal chip 6A against a final shape of the convex part 52 and the noble metal coating layer 6, are preferably set. In one instance, a diameter of the convex part 52 is approximately 0.7 mm, and a height of the convex part 52 is approximately 0.6 mm. As the noble metal chip 6A, for example, in a dimension of the noble metal chip 6A before resistance welding, a diameter is approximately 0.9 mm and a thickness is approximately 0.25 mm. This is when a thickness of the end face coating layer 61 of the noble metal coating layer 6 is approximately 0.2 mm. In a dimension of the noble metal chip 6A after resistance welding, for example, the diameter is approximately 1.1 mm and the thickness is approximately 0.2 mm. In addition, in the tip end opposing part 51 of the ground electrode 5 bonded with the noble metal chip 6A, for example, the width is approximately 2.6 mm and the thickness is approximately 1.4 mm.

Next, as shown in an upper side of FIG. 6, the ground electrode 5 bonded with the noble metal chip 6A is disposed between an upper die 81 and a lower die 82 of an extruding machine 8. Incidentally, the upper side of FIG. 6 is defined as an upper side of the extruding machine 8. A lower side of FIG. 6 is defined as a lower side of the extruding machine 8. The extruding machine 8 is a known structure and has the upper die 81 and the lower die 82. The upper die 81 is a plate shape, and a through hole 812, which penetrates in a vertical direction of the extruding machine 8, is formed in the upper die 81. A punch 811 is fitted in the through hole 812 and is vertically movable. The lower die 82 has a block shape and has a space 83 of a circular cross-sectional shape, which corresponds to the convex part 52. The punch 811 is opposite to the space 83. In the lower die 82, a movable pin 821 is slidably disposed in a through hole 822. The movable pin 821 forms an end face of the space 83. The through hole 822 is formed by being surrounded by a side face of the lower die 82. The movable pin 821 may adjust a projection height of the convex part 52.

In the upper side of FIG. 6, the tip end opposing part 51 of the ground electrode 5 is inserted and is held between the upper die 81 and the lower die 82. Then, the opposing part face 511 of the tip end opposing part 51 is arranged downward. In addition, the noble metal chip 6A faces the space 83 and a diameter thereof is larger than that of the space 83. A part of an outer periphery part of the noble metal chip 6A is contacted with an upper surface of the lower die 82. In the lower die 82, the upper surface does not surround the space 83, but the side face surrounds the space 83. After that, as shown in the lower side of FIG. 6, the punch 811 is lowered to the space 83. Then, an inner periphery face of the through hole 812 acts as a guide face. The electrode base material of the tip end opposing part 51 is extruded from a side of the opposing part rear face 512 to a side of the tip end opposing part face 511 using the punch 811.

The noble metal chip 6A other than a part of the noble metal chip 6A contacted with the lower die 82 is defined as a part A. The part A and the electrode base material on the upper side thereof are extruded into the space 83 using the punch 811. Thereby, the convex part 52 is formed, and the end face coating layer 61 and the side face coating layer 62 of the noble metal coating layer 6 is simultaneously formed. In addition, the whole of the noble metal coating layer 6 is buried in the tip end opposing part 51. The root part 63 and the extension 64 extended therefrom are the noble metal chip 6A not extruded using the punch 811. Then, a thickness of the end face coating layer 61 and the extension 64 are the same as a thickness of the noble metal chips 6A which are before extruding the noble metal chip 6A (e.g. approximately 0.2 mm). In addition, a thickness of the side face coating layer 62 changes depending on the projection height of the convex part 52. That is, an extrusion amount of the noble metal chip 6A using the punch 811 becomes larger as the projection height of the convex part 52 is higher. In addition, a plastic deformation amount of the noble metal chip 6A becomes larger and the thickness of the side face coating layer 62 becomes thinner as the projection height of the convex part 52 is higher. When a height of the convex part 52 is, for example, approximately 0.6 mm, the thickness of the side face coating layer 62 is, for example, approximately 0.1 mm. Thereby, the thickness of the side face coating layer 62 is 30% of a radius of the convex part 52 (e.g. approximately 0.35 mm).

In this way, as shown in FIGS. 3 and 4, the ground electrode 5 is formed in which the whole of the convex part 52 is covered by the noble metal coating layer 6. In the noble metal coating layer 6, the root part 63 and the extension 64 extended from the root part 63 are formed on the whole circumference of the convex part 52. In addition, the whole of the noble metal coating layer 6 is buried in the electrode base material so as to be formed flat on the opposing part face 511.

Figure 7:
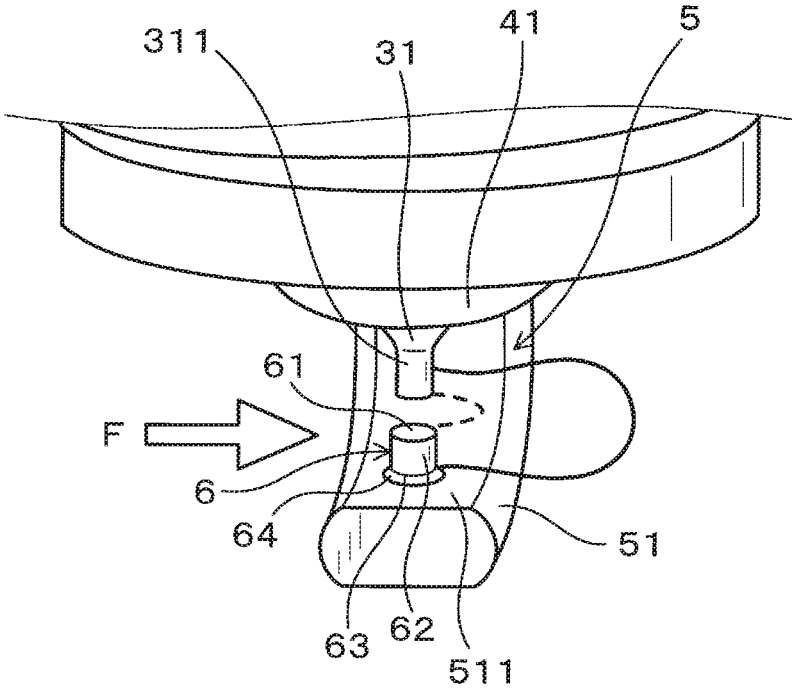
FIG. 7 shows a main part perspective view for explaining an effect of an extension on the tip end opposing part of the ground electrode according to the first embodiment.

Accordingly, as shown in FIG. 7, when a rapidly mixed gas stream is formed in a combustion chamber, an effect for reducing the detaching of the noble metal coating layer 6 may be obtained. That is, when high voltage is applied between the center electrode 3 and the ground electrode 5, spark discharge is normally generated between the columnar small-diameter part 311 and the end face coating layer 61. The columnar small-diameter part 311 includes the noble metal chip. The end face coating layer 61 is a part of the noble metal coating layer 6. However, as indicated by a dotted line in FIG. 7, the spark discharge easily flows to a side of the spark plug 1 due to the mixed gas stream F. When the mixed gas stream flows at higher speed, as indicated by a solid line in FIG. 7, the spark discharge may flow to the side of the spark plug 1 significantly. Thereby, the spark plug may reach the root part 63 of the noble metal coating layer 6. Even in such a case, according to configurations of the present embodiment, the extension 62 is extended from the root part 63 of the side face coating layer 62 to the outside of the spark plug. As a result, consumption of the electrode base material is reduced. In addition, the whole of the root part 63 and the extension 64 is buried in the tip end opposing part 51. Therefore, a joint force between the root part 63 and the extension 64 and the tip end opposing part 51, which is increased. Furthermore, exposure of the boundary face between the electrode base material and the extension 64 becomes the minimum. Thereby, the boundary face is hardly directly exposed to combustion gas, and detaching of the noble metal coating layer 6 due to oxidation and heat stress may be prevented.

Test Example

In the spark plug of the first embodiment, the detaching resistance of the noble metal coating layer 6 of the ground electrode 5 was evaluated by the following method. The spark plug 1 whose extension length L of the extension 64 of the noble metal coating layer 6 changed in a range from 0 mm to 0.2 mm was used (i.e. 0.03 mm, 0.07 mm, 0.1 mm, 0.2 mm).

The spark plug 1 was evaluated for thermal stress and oxidation resistance using a known testing bench for thermal stress. The thermal stress test bench may control and keep the spark plug 1 at a predetermined temperature. As test conditions, conditions of 150° C. and 1000° C. each with a heating and holding time of 6 min were alternately repeated as one cycle. The number of the cycles was 200 cycles. In each of evaluation samples, a vertical cross section (i.e. cross section shown in FIG. 3) of the ground electrode 5 after a thermal test was observed. A detaching length ratio of the noble metal coating layer 6 was calculated by the following formula 1. Then, a sample having a detaching length ratio of not more than 40% was regard as a good item. A sample having the detaching length rate of over 40%, was regarded as a defective item.

$$\text{detaching length rate}=[(L1+L2)/L0]\times 100 \text{ (unit: \%)} \qquad \text{Formula 1}$$

In the formula 1, L0 is an entire length of the noble metal coating layer 6 in the lateral direction Y. The noble metal coating layer had first and second ends faced to each other in the lateral direction Y. L1 is a detached length of the noble metal coating layer 6 at the first end in the lateral direction Y. L2 is a detaching length of the noble metal coating layer 6 at the second end in the lateral direction Y. Twenty evaluation samples, which had respectively the same extension length, was evaluated.

Figure 8:
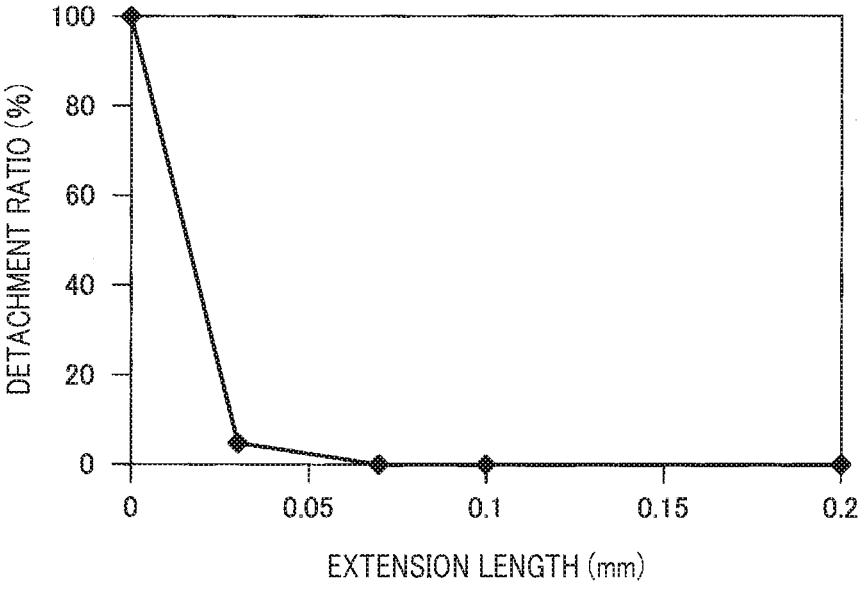
FIG. 8 shows a relationship between a length of the extension on the tip end opposing part of the ground electrode and a detachment ratio according to the first embodiment.

As shown in a test result of FIG. 8, when the extension length L of the extension 64 was 0, that is, when there was no extension 64, all twenty evaluation samples were defective items having the detaching length rate of over 40%. Therefore, a detachment ratio shown in FIG. 8 is 100%. On the other hand, the detaching resistance of the noble metal coating layer 6 was significantly improved by forming the extension 64. For example, when the extension length L was 0.03 mm, the detachment ratio suddenly decreased to 5% (i.e. only one of the twenty evaluation samples was a defective item). In addition, when the extension length L was not less than 0.07 mm, all twenty evaluation samples were good items having the detaching length ratio of not more than 40%. Therefore, the detachment ratio was 0%. Accordingly, the extension length L of the extension 64 is preferably not less than 0.07 mm, and the detaching of the noble metal coating layer 6 may be reliably reduced. It is assumed that the detaching resistance of the noble metal coating layer 6 is improved by providing the extension 64. Specifically, providing the extension 64 allows an area of the boundary face buried in the electrode base material to increase. In addition, providing the extension 64 allows the progress of cracking due to thermal stress to be moderated.

Next, other configuration examples as embodiments 2 to 10 of the tip end opposing part 51 of the ground electrode 5 are described using figures. The basic configuration of each part of the spark plug 1 is the same as in embodiment 1, and further description thereof will be omitted.

Embodiment 2

Figure 9:
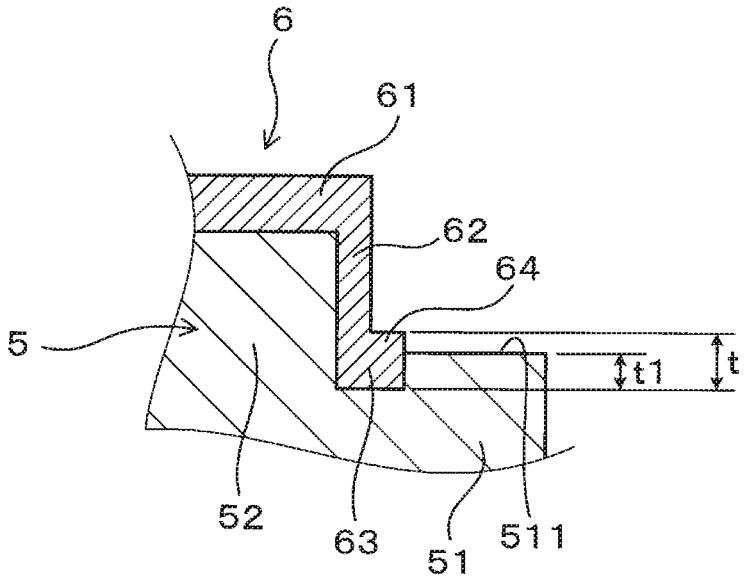
FIG. 9 shows a main part cross sectional view of a tip end opposing part configuration of a ground electrode according to a second embodiment.

As shown in FIG. 9, in a ground electrode 5, at least a part of an extension 64 extended from a root part 63 of a noble metal coating layer 6, which may be buried in a tip end opposing part 51 as illustrated as embodiment 2. Specifically, a ratio of a thickness t1 of a burial part of the extension 64 in the tip end opposing part 51 against a thickness t of the extension 64 may be not less than 10%. A part of a surface of the extension 64 (e.g. surface of the extension 64 disposed on a side of an end face coating layer 61) may be exposed to an outside of an opposing part face 511 (i.e. upper side of FIG. 9). It is assumed that, as shown in FIG. 8, an extension length L of the extension 64 is important to improve detaching resistance. Therefore, the detaching resistance is significantly improved by burying a boundary face between the tip end opposing part 51 and the extension 64. The boundary face is disposed parallel to the opposing part face 511. The ratio of the thickness t1 of the buried part of the extension 64 in the tip end opposing part 51 against the thickness t of the extension 64 may be not less than 30%.

Embodiment 3

Figure 10:
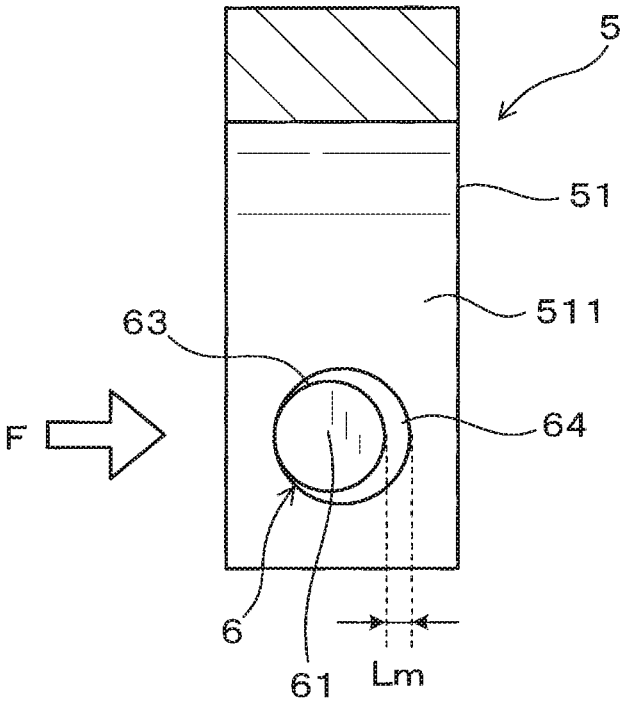
FIG. 10 shows a plan view of a tip end opposing part configuration of a ground electrode according to a third embodiment.

As shown in FIG. 10, in a ground electrode 5, an extension 64 extended from a root part 63 of a noble metal coating layer 6 may be disposed on at least a part of a tip end opposing part 51 as illustrated as embodiment 3. In addition, a width of the extension 64 (i.e. extension length L) may not be constant. Specifically, the extension 64, which has a circular outside shape, is eccentrically disposed against a circular end face coating layer 61 at an outer periphery of the root part 63. In addition, an extension length L of the extension 64 gradually changes. Then, preferably, as shown in FIG. 10, a position where the extension length L becomes minimum is disposed on a side receiving mixed gas stream F in a combustion chamber. A part of the extension 64 opposes the position where the extension length L becomes minimum, which may have a maximum extension length Lm. The extension 64 is eccentrically disposed on a convex part 52, and the extension 64 may be then easily made. Next, a circular noble metal chip 6A which becomes the noble metal coating layer 6 is applied on the tip end opposing part 51.

As shown in FIG. 10, when spark discharge flows to a side of the spark plug 1 due to the mixed gas stream F, the spark discharge is swelled in the flow direction of the mixed gas stream F. Thereby, the spark discharge reaches the root part 63. The extension 64 is disposed on a side where the spark discharge passes due to the mixed gas stream F, and also the extension length L makes larger. Thereby, the same effect reducing detaching of the noble metal coating layer 6 may be obtained. In this case, preferably, the maximum extension length Lm may be not less than 0.07 mm. The extension 64 has a first part and a second part. In the present embodiment, the first part disposed on the side receiving the mixed gas stream F is smaller. The second part of the extension 64 is opposite to the first part of the extension 64. The second part of the extension 64 is larger than the first part of the extension 64. Therefore, detaching resistance of the noble metal coating layer 6 may be improved while reducing usage of noble metal materials.

Embodiment 4

Figure 11:
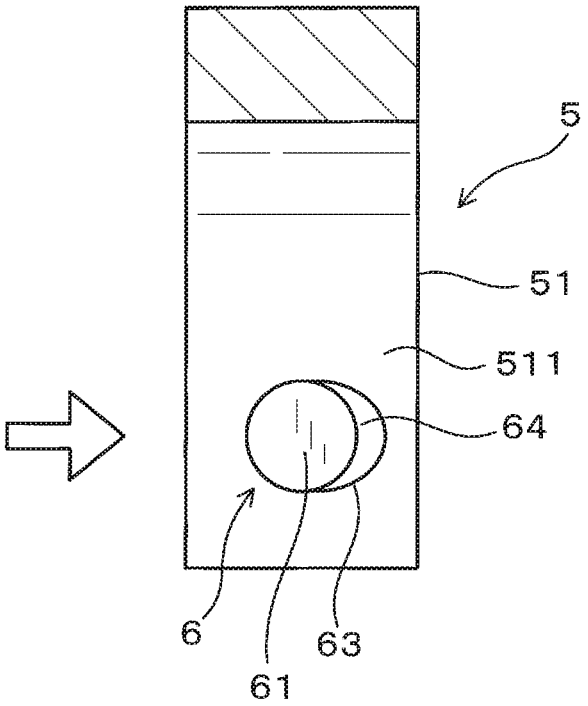
FIG. 11 shows a plane view of a tip end opposing part configuration of a ground electrode according to a fourth embodiment.

As shown in FIG. 11, in a ground electrode 5, an extension 64 may be disposed on only a half part of the noble metal coating layer 6 as illustrated as embodiment 4. The extension 64 is extended from a root part 63 of a noble metal coating layer 6. The half part of the noble metal coating layer 6 is opposite to the mixed gas stream F via the ground electrode 5. In this case, the extension 64 has a semicircular-arc outside shape, and an extension length L of the extension 64 is gradually changed. Thereby, the extension length L of the extension 64 disposed on the half part of the noble metal coating layer 6 becomes a maximum extension length Lm. In this case, usage of noble metal materials is further reduced, and detaching of the noble metal coating layer 6 may be efficiently reduced.

Embodiment 5

Figure 12:
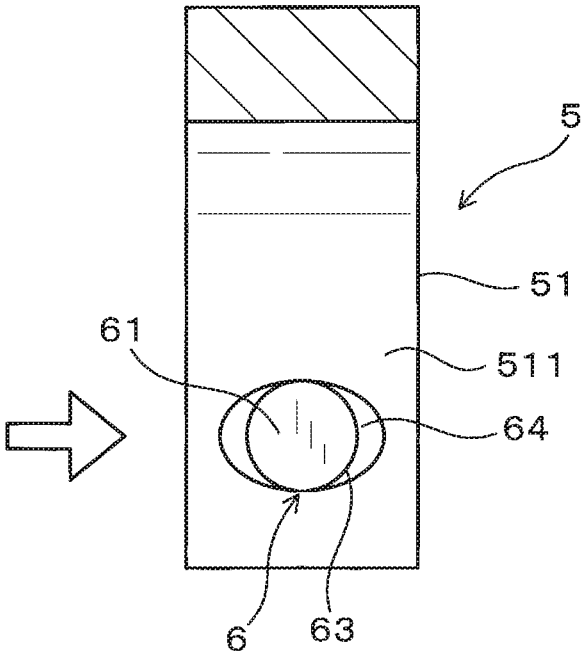
FIG. 12 shows a plane view of a tip end opposing part configuration of a ground electrode according to a fifth embodiment.

As shown in FIG. 12, a semicircular arc-shaped extension 64, which is the same as an outside shape of an extension 64 of embodiment 4, may be disposed on first and second half parts as illustrated as embodiment 5. The extension 64 has the first and the second half parts, and the first half part receives a mixed gas stream F and the second half part is opposite to the first half part via the ground electrode 5. In this case, when the first and the second half parts are combined, the extension 64 has an overall elliptic outside shape. Extension lengths L are gradually changed, and each of the extension lengths L disposed on the first and the second half parts becomes a maximum extension length Lm. In this case, a mounting direction of a spark plug 1 is not limited to a one direction against the mixed gas stream F in a combustion chamber. Thereby, mounting workability of the spark plug 1 becomes good. In addition, when the extension 64 is disposed in a flow direction of the mixed gas stream F, usage of noble metal materials is reduced, and detaching of the noble metal coating layer 6 may be efficiently reduced.

Embodiment 6

Figure 13:
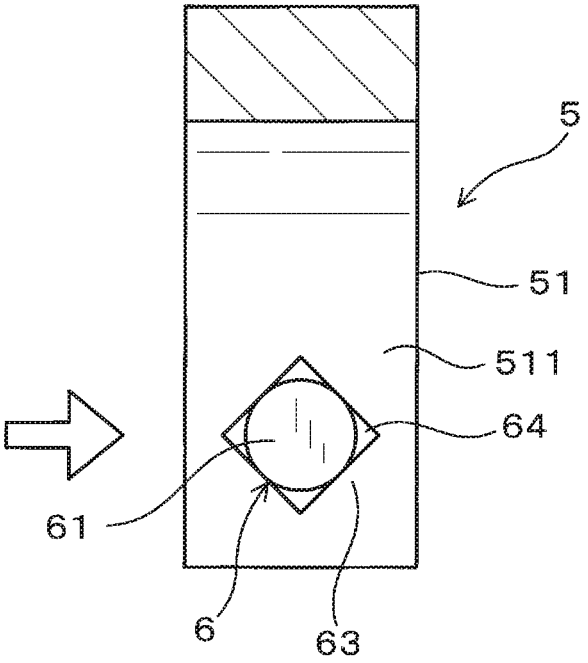
FIG. 13 shows a plane view of a tip end opposing part configuration of a ground electrode according to a sixth embodiment.

As shown in FIG. 13, in a ground electrode 5, an extension 64 extended from each of a root part 63 of a noble metal coating layer 6 may also have a rectangular outside shape as illustrated as embodiment 6. In this case, the extension 64 has four parts respectively extended from an outer periphery of the root part 63 to outward in a radial direction of an end face coating layer 61. The four parts have respectively triangle shapes. When the four parts are combined, the extension 64 has a square outside shape. A length of a side of the square outside shape is the same as a diameter of the end face coating layer 61. A length from a tip of the triangle shape to the outer periphery of the root part is a maximum extension length Lm. In this case, mounting workability of a spark plug 1 becomes good. Usage of noble metal materials is reduced, and detaching of the noble metal coating layer 6 may be efficiently reduced.

Embodiment 7

Figure 14:
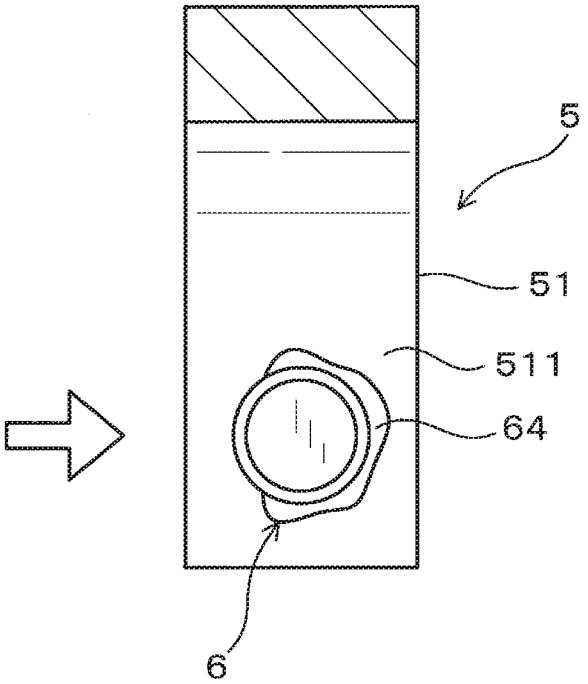
FIG. 14 shows a plane view of a tip end opposing part configuration of a ground electrode according to a seventh embodiment.

As shown in FIG. 14, in a ground electrode 5, an extension 64 extended from a root part of a noble metal coating layer 6, which may be a deformed outside shape, not only a circular outside shape and a rectangular outside shape as illustrated as embodiment 7. In this case, a part of the root part receiving the mixed gas stream F is defined as a part B. There is no extension 64 on the part B. The extension 64, which has a petal outside shape, is disposed so as to surround an outer periphery of the root part other than the part B. The outer periphery of the root part other than the part B is approximately ¾ of the outer periphery of the root part. In this case also, usage of noble metal materials is reduced, and detaching of the noble metal coating layer 6 may be efficiently reduced.

Embodiment 8

Figure 15:
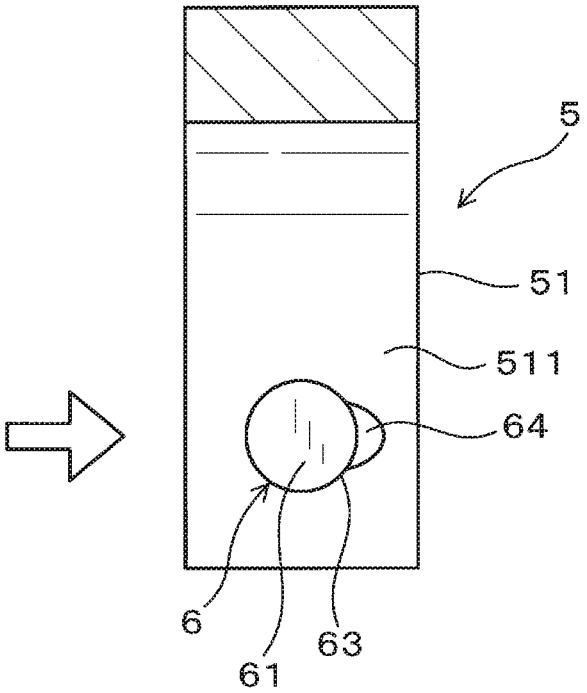
FIG. 15 shows a plane view of a tip end opposing part configuration of a ground electrode according to an eighth embodiment.

As shown in FIG. 15, in a ground electrode 5, an extension 64 extended from a root part 63 of a noble metal coating layer 6 may be disposed on a part of the root part not receiving mixed gas stream F as illustrated as embodiment 8. In this case, the extension 64 has a circular-arc outside shape. An extension length L of the extension 64 is gradually changed, and the extension length L of the extension 64 disposed on the part of the root part not receiving the mixed gas stream F has a maximum extension length Lm. In this case, usage of noble metal materials is reduced, and detaching of the noble metal coating layer 6 may be efficiently reduced.

Embodiment 9

Figure 16:
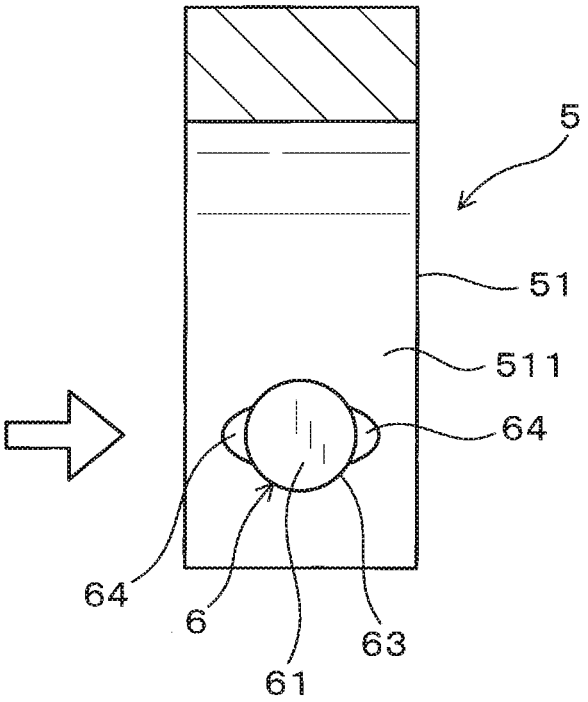
FIG. 16 shows a plane view of a tip end opposing part configuration of a ground electrode according to a ninth embodiment.

As shown in FIG. 16, two extensions 64 may have circular-arc outside shapes as the same as the extension 64 of embodiment 8 as illustrated as embodiment 9. Two extensions 64 are made up of a first extension 64 and a second extension 64. A part of a root part receiving a mixed gas stream F is defined as a part AA. A part of the root part not receiving the mixed gas stream F is defined as a part BB. The first extension 64 is disposed on the part AA and the second extension 64 is disposed the part BB. The first extension 64 is opposite to the second extension 64 via the ground electrode 5. Extension lengths L of the two extensions 64 are gradually changed, and the extension lengths L of the two extension 64 respectively disposed on the part AA and the part BB, which become maximum extension lengths Lm. In this case, mounting workability of the spark plug 1 becomes good. In addition, usage of noble metal materials is reduced, and detaching of the noble metal coating layer 6 may be efficiently reduced.

Embodiment 10

Figure 17:
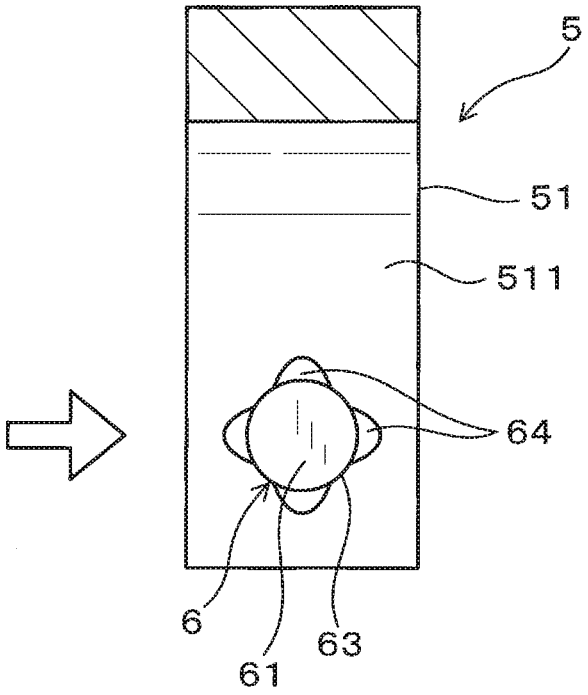
FIG. 17 shows a plane view of a tip end opposing part configuration of a ground electrode according to a tenth embodiment.

As shown in FIG. 17, four extensions 64 may have circular-arc outside shapes as the same as the extension 64 of embodiment 8 as illustrated as embodiment 10. The four extensions 64 may be respectively disposed on four parts of an outer periphery of a root part 63. Then, extension lengths L are gradually changed, and the extension lengths L of the four extensions 64 respectively disposed on the four parts of the outer periphery of the root part 63 define the maximum extension length Lm. In this case, mounting workability of the spark plug 1 further becomes good. In addition, usage of noble metal materials is reduced, and detaching of the noble metal coating layer 6 may be efficiently reduced.

The present disclosure is not intended to be limited to embodiments, and various modifications are possible without departing from the scope and spirit thereof. For example, a configuration that the side face coating layer 62 of the noble metal coating layer 6 covers a whole peripheral surface of the convex part 52, which is described in embodiments. The side face coating layer 62 may not necessarily cover the whole peripheral surface of the convex part 52. For example, the root part 63 of the side face coating layer 62 may not necessarily reach a base part of the convex part 52 in a part of the outer periphery of the convex part 52. In addition, the root part 63 may not necessarily be buried in the tip end opposing part 51 in the part of the outer periphery of the convex part 52. In this case, preferably, the extension 64 is disposed on a side of root part not receiving mixed gas stream F, and the extension 64 is disposed from the root part 63 to outside of the spark plug 1.

In addition, in embodiments, an outer shape of the noble metal coating layer 6 including the extension 64 may be a circular shape, a semicircular-arc shape, a modificated circular shape or a rectangular shape. The outer shape of the noble metal coating layer 6 is not intended to be limited to these shapes. The outer shape of the noble metal coating layer 6 may be a polygonal shape such as a triangular shape, a shape or the like which combines these shapes, or any other shape. In addition, a shape of the convex part 52 covered by the noble metal coating layer 6 is not also specially intended to be limited. The shape of the convex part 52 may be, for example, a polyangular cylindrical shape, a polygonal pyramid shape, or a shape which combines these shapes besides a cylindrical shape and a conical shape. In addition, respective parts configuring the spark plug 1 of the center electrode 3 and any other spark plug may be appropriately changed.

What is claimed is:

1. A spark plug comprising:

an elongated shaft shaped center electrode held inside a cylindrical housing;

a cylindrical insulator disposed between the center electrode and the housing;

a ground electrode fixed at a tip end of the housing and having a tip end opposing part opposing the center electrode;

a convex part which is disposed on the tip end opposing part, and the convex part is projected from an opposing part face opposing the center electrode towards the center electrode in an axial direction of the spark plug, and a spark discharge gap is formed between a tip end part of the center electrode and the convex part; and a noble metal coating layer covering a surface of the convex part, wherein the noble metal coating layer has an end face coating layer and a side face coating layer, the end face coating layer covers a projecting end face of the convex part, the side face coating layer covers at least a part of a side face of the convex part extended from the projecting end face, wherein a root part of the side face coating layer which is disposed at a position opposed to the projecting end face, is buried in the tip end opposing part, an extension is formed so that at least a part of the root part is extended to an outside of the spark plug along the opposing part face.

2. The spark plug as set forth in claim 1, wherein the side face coating layer is disposed by covering a whole peripheral surface of the convex part.

3. The spark plug as set forth in claim 2, wherein the extension is disposed on an entire outer circumference of the root part.

4. The spark plug as set forth in claim 2, wherein the extension is disposed on one or several positions of the outer circumference of the root part.

5. The spark plug as set forth in claim 1, wherein a maximum extension length of the extension disposed on the opposing part face is not less than 0.07 mm.

6. The spark plug as set forth in claim 1, wherein a surface of the extension is formed flat on the opposing part face.

7. The spark plug as set forth in claim 1, wherein the convex part is made of a part of a base material of the ground electrode; and the convex part has a circular or a semicircular-arc projected shape.

8. A method of manufacturing the spark plug as set forth in claim 1 comprising:

resistance welding a plate noble metal chip which becomes the noble metal coating layer to the tip end opposing part;

burying at least a part of the noble metal chip in the tip end opposing part;

forming the convex part by extruding a part of the tip end opposing part to a side of the opposing part face at a portion where the noble metal chip is buried so that the convex part is covered by the end face coating layer and side face coating layer; and integrally forming the extension, which is extended from the root part of the side face coating layer along the opposing part face, with the convex part.

* * * * *